US007175921B2

(12) United States Patent
Hatono et al.

(10) Patent No.: US 7,175,921 B2
(45) Date of Patent: Feb. 13, 2007

(54) COMPOSITE STRUCTURE BODY AND METHOD FOR MANUFACTURING THEREOF

(75) Inventors: Hironori Hatono, Fukuoka (JP); Masakatsu Kiyohara, Fukuoka (JP); Katsuhiko Mori, Fukuoka (JP); Tatsuro Yokoyama, Fukuoka (JP); Atsushi Yoshida, Fukuoka (JP); Tomokazu Ito, Fukuoka (JP); Jun Akedo, Ibaraki (JP)

(73) Assignees: National Institute of Advanced Industrial Science and Technology, Tokyo (JP); Toto Ltd., Fukuoka (JP)

( * ) Notice: Subject to any disclaimer, the term of this patent is extended or adjusted under 35 U.S.C. 154(b) by 377 days.

(21) Appl. No.: 10/399,903

(22) PCT Filed: Oct. 23, 2001

(86) PCT No.: PCT/JP01/09304

§ 371 (c)(1),
(2), (4) Date: Aug. 26, 2003

(87) PCT Pub. No.: WO02/36855

PCT Pub. Date: May 10, 2002

(65) Prior Publication Data

US 2004/0043230 A1 Mar. 4, 2004

(30) Foreign Application Priority Data

Oct. 23, 2000 (JP) ..... 2000-322846

(51) Int. Cl.
*B32B 9/00* (2006.01)

(52) U.S. Cl. ..... 428/689; 428/688

(58) Field of Classification Search ..... None
See application file for complete search history.

(56) References Cited

U.S. PATENT DOCUMENTS 5,296,667 A * 3/1994 Marantz et al. ..... 219/121.47

(Continued)

FOREIGN PATENT DOCUMENTS

JP 59-080361 5/1984

(Continued)

OTHER PUBLICATIONS

New Ceramics (1997: No. 2) pp. 6-13.

(Continued)

*Primary Examiner*—Jennifer C. McNeil
*Assistant Examiner*—Elizabeth D. Ivey
(74) *Attorney, Agent, or Firm*—Carrier, Blackman & Associates, P.C.; Joseph P. Carrier; William D. Blackman

(57) ABSTRACT

A structure body having the constitution in which the crystals of a brittle material such as a ceramic, a metalloid and the like and the crystals or the microstructures (the microstructure bodies composed of amorphous metal layers and an organic substance) of a ductile material such as a metal and the like are dispersed, the structure bodies (the portion composed of the brittle material) are polycrystalline, the crystals constituting the structure bodies substantially lack the crystalline orientation, and boundary layers composed of glassy substances are substantially absent in the boundary face between the crystals. It is thereby possible to obtain a structure body having novel characteristics, composed of a brittle material and a ductile material, without involving a heating/sintering process.

21 Claims, 4 Drawing Sheets

U.S. PATENT DOCUMENTS 5,928,719 A * 7/1999 Mishima et al. ..... 427/180

FOREIGN PATENT DOCUMENTS

| | | |
|---|---|---|
| JP | 59-087077 | 5/1984 |
| JP | 61-209032 | 9/1986 |
| JP | 06-116743 | 4/1994 |
| JP | 2000-212766 | 8/2000 |

OTHER PUBLICATIONS

New Ceramics (in Japanese) (1998, vol. 11, No. 5).
Materials Integration (2000 vol. 13, No. 4).
The gas deposition method (Seiichirou Kashu, Kinzoku, Jan. 1989).
The electrostatic fine particle coating method (Ikawa et al., Preprint for the Science Lecture Meeting, Autumn Convention, Precision Machine Society Showa 52 (1977)).

* cited by examiner

COMPOSITE STRUCTURE BODY AND METHOD FOR MANUFACTURING THEREOF

TECHNICAL FIELD

The present invention relates to a structure body composed of a brittle material such as a ceramic, a semiconductor, and the like and a ductile material such as a metal and the like, a composite structure body in which the structure body is formed on a substrate, and a method for manufacturing thereof.

The composite structure body involved in the present invention can be applied to, for example, a nano-composite magnet, a magnetic refrigerator element, an abrasion resistant surface coat, a higher-order structure piezoelectric element composed of a mixture of piezoelectric materials different in frequency response property, a heating element, a higher-order structure dielectric displaying the characteristics over a wide range of temperature, a photocatalyst material and the induction material thereof, a minute machine part, an abrasion resistant coat for a magnetic head, a sliding member material, an abrasion resistant coat of a die and mending the abraded and chipped parts thereof, an artificial bone, an artificial dental root, a condenser, an electronic circuit part, a sliding part of a valve, a pressure-sensitive sensor, an optical shutter, a supersonic sensor, an infrared sensor, an antivibration plate, a cutting machining tool, a surface coat of a copying machine drum, a temperature sensor, the insulation coat of a display, a ceramic heating element, a microwave dielectric, an antireflection film, a heat ray reflecting film, a UV absorbing film, an inter-metal dielectric layer (IMD), a shallow trench isolation (STI), a brake, and a clutch facing; an electronic/magnetic device improved in electric, magnetic, and mechanical properties by metal dispersion, such as a magnetic shielding coat, a peripheral inclined structure body promoting the heat conduction to a thermoelectric conversion element, a piezoelectric element made to be tough by the interposed metal layers, an electrostatic chuck regulated in electric resistance, and the like; and an antifouling surface coat comprising a mixture of a water-repellent fluoride and a photocatalytic material and the like.

BACKGROUND ART

Among the so-called composite materials, those composite materials which are composed of such brittle materials as ceramics and the like have been developed as structural materials or functional materials, and encompass conventional rather macroscopic materials with particles, fibers, and the like dispersed in the matrices thereof and recent composite mesoscopic materials and nanocomposite materials designed for the composite formation on the crystal level, the recent ones being highlighted. The nanocomposite materials include the intra-crystal nanocomposite type in which nanosize crystals of other materials are introduced either into the interior of a grain or into the grain boundary, and the nano-nanocomposite type in which nanosize crystals of different materials are mixed. Some nanocomposite materials are expected to display hitherto unknown characteristics, and related research papers have been published.

In NEW CERAMICS (1997: No. 2), there is found a description that a raw material is produced in which the ultra-fine particles made of zirconia surround the particles of an alumina raw powder, and the raw material thus produced is sintered to yield a nanocomposite.

In New Ceramics (in Japanese) (1998, Vol. 11, No. 5), there is found a description that a composite powder is produced by depositing Ag particles or Pt particles on the surface of a PZT raw powder in such a way that the surface of ceramic fine particles undergoes a chemical process such as the electroless plating method, and the composite powder thus obtained is sintered to yield a nanocomposite.

Additionally, in New Ceramics (in Japanese) (1998, Vol. 11, No. 5), there is found a description that as the materials for use in preparing nanocomposites, there can be cited $Al_2O_3$/Ni, $Al_2O_3$/Co, $Zr_2O$/Ni, $Zr_2O$/SiC, $BaTiO_3$/SiC, $BaTiO_3$/Ni, ZnO/NiO, PZT/Ag, and the like, and the sintering of these materials gives nanocomposites.

The nanocomposites disclosed in these articles are all obtained by sintering, which induces the grain growth so that the grain size tends to become coarse and large, and accordingly there occurs such a limitation that the sintering does not lead to oxidation. Additionally, in the case where a composite body composed of a ceramic and a metal is formed, if the sintering temperature of the ceramic and the melting point of the metal are remarkably different from each other, in some case the metal is evaporated at the sintering temperature, and thus there occurs a problem that the control of the composition ratios is difficult, and other like problems. Furthermore, in the case where a metal is plated on the surface of the ceramic powder by the electroless plating and the like, the applicable metal is limited, and there is a fear that the impurity contamination occurs in the wet process.

On the contrary to the above described nanocomposites which are obtained by sintering, in Materials Integration (2000, Vol. 13, No. 4), there is found a description that a variety of Cr/$CrO_x$ nanocomposite thin films can be obtained by the reactive low-voltage magnetron sputtering method with a Cr target under the condition that the $O_2$ partial pressure is varied. According to this method, however, it is impossible to conduct the nanosize crystal deposition of mixed fine particles of different types in the form of dispersed particles instead of in the form of laminated layers.

On the other hand, as the recent novel methods of coating film formation, there have been known the gas deposition method (Seiichirou Kashu, Kinzoku (Metals, in Japanese), January, 1989) and the electrostatic fine particle coating method (Ikawa et al., Preprint (in Japanese) for the Science Lecture Meeting, Autumn Convention, Precision Machine Society, Showa 52 (1977)). The fundamental principle of the former method is as follows: the fine particles of metals, ceramics, and the like are converted into aerosols by gas agitation, and accelerated through a fine nozzle so that a part of the kinetic energy is converted into heat when colliding with the substrate, which leads to the sintering found either among the particles or between the substrate and particles. The fundamental principle of the latter method is as follows: the fine particles are charged, accelerated in a gradient of electric field, and the subsequent sintering involves the use of the heat generated in bombardment in a similar manner to that in the former method.

In this connection, as the preceding techniques in which the above descried gas deposition method is applied to mixed fine particles of different types, there have been known the techniques disclosed in Japanese Patent Publication No. 3-14512 (Japanese Patent Laid-Open No. 59-80361), Japanese Patent Laid-Open No. 59-87077, Japanese Patent Publication No. 64-11328 (Japanese Patent Laid-Open No. 61-209032), and Japanese Patent Laid-Open No. 6-116743.

In the contents proposed in the above Japanese Patent Publications, the different types of fine particles are based on such metals (ductile materials) as Ag, Ni, Fe and the like; namely, no specific suggestions are found therein with respect to the formation of the nanocomposites of metals and ceramics (brittle materials) or the composites of organics and inorganics.

Additionally, the techniques described above take as their fundamental principle the film formation composed of mixed fine particles through melting or partially melting the raw material ultra-fine particles, but without using adhesive agents, so that there are involved such auxiliary heating devices as an infrared heating device and the like.

On the other hand, no nanocomposite was cited therein, but the present inventors proposed a method for producing the films of ultra-fine particles, excluding heating with heating measures, in Japanese Patent Laid-Open No. 2000-212766. In the technique disclosed in this Japanese Patent Laid-Open No. 2000-212766, a structure body is formed through promoting the mutual bonding of the ultra-fine particles in such a way that the ultra-fine particles of 10 nm to 5 μm in particle size are irradiated with an ion beam, an atomic beam, a molecular beam, a low-temperature plasma, or the like, in order to activate the ultra-fine particles without melting thereof and blow them onto a substrate at a rate of 3 m/sec to 300 m/sec.

The above described prior arts can be summarized as follows: the prior composites referred to as nanocomposites are obtained by sintering almost without exception, and the sintering is inevitably accompanied by the crystal grain growth, leading to the larger average grain size of the composites as compared to that of the raw material fine particles, and hence inducing the difficulty in obtaining such composites as excellent in strength and denseness; in this connection, a proposal has been made for suppressing the crystal grain growth, but the fact is that there is found some limitation to the types of raw materials to which the proposal is applicable.

Furthermore, even a method of coating film formation with fine particles involving no sintering needs some kind of surface activation procedure, almost no considerations are given to the ceramics, and exactly no reference is made to the nanocomposites composed of brittle materials such as ceramics and ductile materials such as metals.

The present inventors have been engaged in the subsequent check and confirmation investigation on the technique disclosed in Japanese Patent Laid-Open No. 2000-212766. Consequently, the present inventors have been successful in revealing that there is definite difference in behavior between metals (ductile materials) and brittle materials including ceramics and semiconductors.

More specifically, as for the brittle materials, the structure bodies were able to be formed without using the irradiation of the ion beam, atomic beam, molecular beam, low-temperature plasma, or the like, namely, without using any particular activation procedure, although there was still a problem that the structure bodies were unsatisfactory in the peel strength or partially tended to be peeled off or the density is not uniform, when there were implemented just the fine particle size of 10 nm to 5 μm and bombardment velocity of 3 m/sec to 300 m/sec as specified in the conditions described in the above mentioned patent laid-open.

On the basis of the above described considerations, the present inventors reached the following conclusions.

The ceramics take the atomic bonding condition that the free electrons are scarcely found and the covalent bonding or the ionic bonding is predominant. Thus, they are hard but brittle. The semiconductors such as silicon, germanium and the like are also brittle materials without ductility. Accordingly, when mechanical impact is exerted to the brittle materials, for example, the crystal lattice dislocation occurs along such a cleavage plane as the boundary face of the crystallites, or the fracture occurs. Once these phenomena have occurred, there are found such atoms as exposed on the dislocation plane and the fracture plane, although these atoms have been originally located in the interior where they have been bonded to other atoms; namely, a new surface is thus formed. The atomic single layer part on the new surface is forced by the external force to make transition to the exposed and unstable surface state from the originally stable atomic bonding state, giving rise to, in other words, a high surface energy state. This activated surface is bonded to the adjacent surface of the brittle material as well as another adjacent new surface of the brittle material or the adjacent substrate surface, thus being converted to a stable state. Exertion of continuous, external mechanical impact makes this phenomenon to occur continuously, and the accompanying repeated distortion and fracture of the fine particles lead to the joining development, densifying the thereby formed structure body. Thus, the structure bodies of the brittle materials are formed.

DISCLOSURE OF THE INVENTION

The present invention has been perfected on the basis of the idea that since as described above the formation of new surfaces in the brittle materials makes it possible to form the structure bodies, a brittle material can be taken as a binder, and hence a composite structure body composed of a brittle material and a ductile material, and having hitherto unknown characteristics can be formed.

The microscopic structure of the composite structure bodies involved in the present invention formed on the basis of the above described idea is obviously different from that of the structure bodies obtained by the conventional production methods.

More specifically, in the constitution of the structure bodies involved in the present invention, there are dispersed the crystals of one or more than one types of brittle materials such as ceramics, semiconductors, and the like, and the crystals and/or microstructures (the microstructures composed of amorphous metal layers and an organic substance) of one or more than one types of ductile materials such as metals and the like; and the portion composed of the brittle material crystals is polycrystalline, the crystals constituting the polycrystalline portion substantially lack the crystalline orientation, and the boundary face between the crystals of the brittle materials substantially has no grain boundaries composed of glassy substances.

Additionally, in a composite structure body formed through formation of the above described structure body on a substrate, a portion of the structure body becomes the anchor portion biting the substrate surface.

In the formation of the above described anchor portion, there can be seen the formation of the multi-layer anchor portion in which the brittle material deforms the ductile material on the deposition structure of the ductile material fine particles to generate the anchor effect, through the use of the mixed fine particles of a ductile material and a brittle material, and this is advantageous for manufacturing a structure body that is large in deposition height and in strength.

Here are explained the technical terms important for the purpose of understanding the present invention as follows.

(Polycrystal)

In the present specification, this term means a structure body which is formed through the joining and agglomeration of crystallites. A crystallite alone substantially constitutes a crystal, the size of which is 5 nm or more. However, there rarely occurs the case in which fine particles are incorporated, without undergoing fracture, into the structure body, and the like cases; nevertheless, the structure bodies in these cases substantially can be regarded as polycrystalline.

(Crystalline Orientation)

In the present specification, this term means the orientation of the crystal axes in a polycrystalline structure body, and the estimation as to whether the orientation is present or absent is made by reference to the JCPDS (ASTM) data which was prepared as the standard data by the powder X-ray analysis and the like of the powders that were regarded as substantially lacking the orientation.

In the present specification, the substantial absence of the orientation refers to the following condition: when the 100% intensities are allotted to the respective intensities of the main three diffraction peaks in the above reference data that cite the material constituting the brittle material crystals in the structure body, and the intensity of the strongest main peak in the same brittle material in the structure body is taken to be the same as that of the corresponding reference intensity, the intensities of the other two peaks fall within 30% in deviation as compared to the corresponding reference data intensities.

(Boundary Face)

In the present specification, this term means the regions which constitute the mutual boundaries between the crystallites.

(Boundary Layer)

This term means the layer having a certain thickness (usually, a few nm to a few μm) which is situated in the boundary face or in the grain boundary as referred to for the sintered body; this layer usually takes an amorphous structure different from the crystal structure found in a crystal particle, and is in some cases accompanied by the impurity segregation.

(Anchor Portion)

In the present specification, this term means the irregularities formed on the interface between the substrate and the structure body; in particular, this term means the irregularities formed by varying in the structure body formation the surface precision of the original substrate, but does not mean the irregularities formed on the substrate in advance of the structure body formation.

(Average Crystallite Size)

This term means the crystallite size which is calculated by the Scherrer method in the X-ray diffraction method, and is measured and calculated by means of an MXP-18 apparatus manufactured by MacScience Co.

(Internal Distortion)

This term means the lattice distortion found in the fine particles which is calculated by the Hall method in the X-ray diffractometry, and is represented in percentages as the deviation found by reference to the standard material prepared by full annealing of fine particles.

(Brittle Material Fine Particle or Velocity of Composite Fine Particle)

The above velocity means the average velocity calculated according to the measurement method on the fine particles as shown in Example 3.

As for the conventional nanocomposites formed by sintering, the crystals are accompanied by the thermal grain growth, and glassy layers are formed as boundary layers particularly in the case where sintering aids are used.

On the other hand, in the structure bodies involved in the present invention, the distortion or fracture goes with the brittle material fine particles among the raw material fine particles, and accordingly the constituent grain of the structure bodies are smaller than the raw material fine particles. With the average fine particle size of, for example, 0.1 to 5 μm as measured by the laser diffraction method or the laser scattering method, the average crystallite size of a formed structure body frequently becomes 100 nm or less, and the polycrystals composed of such fine crystallites are contained in the structures of the structure body. Consequently, there can be formed the dense structure body that is 500 nm or less in the average crystallite size and 99% or more in the denseness degree, 100 nm or less in the average crystallite size and 95% or more in the denseness degree, or 50 nm or less in the average crystallite size and 70% or more in the denseness degree.

Here, the denseness degree (%) is calculated by the formula, the bulk specific gravity÷the true specific gravity× 100(%), where the true specific gravity is based on the literature value or theoretical calculated value and the bulk specific gravity is obtained from the weight and volume values of the structure body.

Additionally, the composite structure bodies involved in the present invention are characterized in that: the structure bodies are accompanied by the distortion or fracture induced by such mechanical impact as bombardment and the like so that the crystal shapes of flat or thin and long are difficult to exist, and the forms of the involved crystallites can be regarded as nearly particle-like and the aspect ratio nearly amounts to 2.0 or less; and additionally, the structure is ascribable to the rejoining fraction of the fractured fragment particles, and accordingly lack the crystal orientation and are almost dense, so that the structure bodies are excellent in such mechanical and chemical properties as hardness, abrasion resistance, corrosion resistance, and the like.

Additionally, in the present invention, it takes a very short time to cover from the fracturing and to the rejoining of the brittle material fine particles, so that at the time of joining the atomic diffusion hardly occurs in the vicinity of the surface of the fine fragment particles. Accordingly, the atomic disposition in the boundary face between the crystallites of the structure body is free from disturbance, and the boundary layers (glassy layers), namely, the molten layers, are hardly formed, or are 1 nm or less even if formed. Thus, the structure bodies display the characteristic excellent in such chemical properties as the corrosion resistance and the like.

Additionally, the structure bodies involved in the present invention include those structure bodies which have the nonstoichiometric deficient portion (for example, deficient in oxygen) in the vicinity of the boundary face constituting the structure body.

Additionally, as the substrates on the surfaces of which the composite structure bodies involved in the present invention are formed, there can be cited glass, metals, ceramics, semiconductors, or organic compounds; and as the brittle materials, there can be cited the oxides including aluminum oxide, titanium oxide, zinc oxide, tin oxide, iron oxide, zirconium oxide, yttrium oxide, chromium oxide, halfnium oxide, beryllium oxide, magnesium oxide, silicon oxide, and the like; diamond and the carbides including boron carbide, silicon carbide, titanium carbide, zirconium carbide, vanadium carbide, niobium carbide, chromium carbide, tungsten carbide, molybdenum carbide, tantalum carbide, and the like; the nitrides including boron nitride, titanium nitride, aluminum nitride, silicon nitride, niobium nitride, tantalum nitride, and the like; boron and the borides including aluminum boride, silicon boride, titanium boride, zirconium boride, vanadium boride, niobium boride, tantalum boride, chromium boride, molybdenum boride, tungsten boride, and the like; or the mixtures and the multicomponent-system solid solutions of these substances; the piezoelectric/pyroelectric ceramics including barium titanate, lead titanate, lithium titanate, strontium titanate, aluminum titanate, PZT, PLZT, and the like; the tough ceramics including sialon, cermet, and the like; the biocompatible ceramics including hydroxy apatite, calcium phosphate, and the like; silicon, germanium, and the semiconducting substances composed of silicon or germanium doped with various dopants including phosphorus and the like; and the semiconducting compounds including gallium arsenide, indium arsenide, cadmium arsenide, and the like. Furthermore, in addition to these inorganic materials, there can be cited the brittle organic materials including hard vinyl chloride, polycarbonate, acryl, and the like. As the ductile materials, there can be cited the metallic materials including iron, nickel, chromium, cobalt, zinc, manganese, copper, aluminum, gold, silver, platinum, titanium, magnesium, calcium, barium, strontium, vanadium, palladium, molybdenum, niobium, zirconium, yttrium, tantalum, halfnium, tungsten, lead, lanthanum, and the like; the alloy materials containing these metals as the main components; the compound materials covering both ductile and brittle materials; and additionally, the organic compounds including polyethylene, polypropylene, ABS (acryl-butadiene-styrene copolymer), fluorocarbon resin, polyacetal, acryl resin, polycarbonate, polyethylene, poly(ethylene terephtalate), hard vinyl chloride resin, unsaturated polyester, silicone, and the like. and the multicomponent-system solid solutions of these substances; the piezoelectric/pyroelectric ceramics including barium titanate, lead titanate, lithium titanate, strontium titanate, aluminum titanate, PZT, PLZT, and the like; the tough ceramics including sialon, cermet, and the like; the biocompatible ceramics including hydroxy apatite, calcium phosphate, and the like; silicon, germanium, and the semiconducting substances composed of silicon or germanium doped with various dopants including phosphorus and the like; and the semiconducting compounds including gallium arsenide, indium arsenide, cadmium arsenide, and the like. Furthermore, in addition to these inorganic materials, there can be cited the brittle organic materials including hard vinyl chloride, polycarbonate, acryl, and the like. As the ductile materials, there can be cited the metallic materials including iron, nickel, chromium, cobalt, zinc, manganese, copper, aluminum, gold, silver, platinum, titanium, magnesium, calcium, barium, strontium, vanadium, palladium, molybdenum, niobium, zirconium, yttrium, tantalum, hafnium, tungsten, lead, lanthanum, and the like; the alloy materials containing these metals as the main components; the compound materials covering both ductile and brittle materials; and additionally, the organic compounds including polyethylene, polypropylene, ABS (acryl-butadiene-styrene copolymer), fluorocarbon resin, polyacetal, acryl resin, polycarbonate, polyethylene, poly(ethylene terephtalate), hard vinyl chloride resin, unsaturated polyester, silicone, and the like.

Additionally, the thickness of the structure body in the present invention (exclusive of the substrate thickness) can be made to be 50 μm or more. The surface of the above mentioned structure body is not flat and smooth microscopically. The flat and smooth surface is required, when an abrasion-resistant sliding member is produced, for example, by coating the surface of a piece of metal with a highly hard structure body (a nanocomposite), and accordingly surface grinding or polishing is necessary in a later process. In such application, it is desirable that the deposition height of the structure body is made to be of the order of 50 μm or more. When surface grinding is conducted, it is desirable that the deposition height is 50 μm or more because of the mechanical restriction imposed on the grinding machine; in this case, the grinding of several tens of micrometers is carried out, so that the surface of 50 μm or less comes to form a flat and smooth thin film.

Additionally, in some cases, it is desirable that the thickness of the structure body is 500 μm or more. The present invention takes as an object not only the production of the structure body film which is formed on a substrate made of a metallic material or the like and has the functions such as the high hardness, abrasion resistance, heat resistance, corrosion resistance, chemical resistance, electric insulation and the like, but also the production of the structure body which can be used alone. Although the mechanical strengths of the ceramic materials are diverse, a structure body of 500 μm or more in thickness can give the strength sufficient for application to, for example, the ceramic substrates and the like, as far as the qualities of the materials are properly chosen.

For example, it is possible to produce a mechanical component made of a composite material at room temperature in the following way: the composite material ultra-fine particles are deposited on the surface of a sheet of metal foil placed on the substrate holder to form a dense structure body which is 500 μm or more in thickness all over the composite structure body or partially, and subsequently the metal foil part is removed or some other like process is performed.

On the other hand, the method for manufacturing the composite structure body in the application concerned forms the structure body, composed of the structure in which the crystals of the brittle material and the crystals and/or microstructures of the ductile material are dispersed, in the following manner: the brittle material fine particles and the ductile material fine particles are simultaneously or separately bombarded against a substrate surface with high velocities; the brittle material fine particles and the ductile material fine particles are distorted or fractured by the bombardment impact; in the brittle fine particles, the mutual rejoining of the fine particles is made through the intermediary of a newly generated active surface formed by the distortion or fracture; and furthermore an anchor portion with a part thereof biting the substrate surface is formed, to join with the substrate, in the boundary portion between the substrate and the brittle material fine particles and/or the ductile material fine particles.

As the procedures in which the fine particles of brittle materials and the fine particles of ductile materials are bombarded at high velocities, there can be cited the carrier gas method, the method accelerating the fine particles by use of the electrostatic force, the thermal spraying method, the cluster ion beam method, the cold spray method, and the like. Among these methods, the carrier gas method is conventionally referred to as the gas deposition method, and is a method for forming a structure body in which the aerosol containing the fine particles of metals, semiconductors, or ceramics is blown off from a nozzle and is sprayed at a high speed onto the substrate to deposit the fine particles on the substrate, and there is thereby formed a deposition layer of the green compacts having the same composition as that of the fine particles and the like layers. Here, among these methods, in particular, the method for forming structure bodies directly on the substrate will be referred to as the ultra-fine particles beam deposition method or the aerosol deposition method; in the present specification, the manufacturing method involved in the present invention will be referred to as this name in what follows.

When the aerosol of the material fine particles is bombarded by use of the ultra-fine particles beam deposition method, the mixed powder aerosol may be prepared beforehand, or the aerosols of the individual materials may be generated and bombarded either independently or simultaneously while varying the mixing ratio of the aerosol. The last case is preferable in the sense that a structure body having a declined composition can be easily formed.

The method for manufacturing the composite structure bodies involved in another embodiment of the present invention includes a method in which the composite particles are formed through the process of coating the surface of the brittle material fine particles with one or more than one types of ductile materials, and subsequently the composite fine particles are bombarded against the substrate surface with a high velocity.

As the method for coating the surface of the brittle material fine particles with the ductile material, the procedure mimicking the PVD, CVD, plating or mechanical alloying method may be adopted, or it may be sufficient that ultra-fine particles further smaller in particle size are only made to adhere by kneading or the like onto the surface of the fine particles.

The method for manufacturing the composite structure bodies involved in yet another embodiment of the present invention forms a structure body, above the anchor portion, comprising the structure in which the brittle material crystals and the crystals and/or microstructures of the ductile material are dispersed in the following manner: the brittle material fine particles and the ductile material fine particles are arranged on the substrate surface; a mechanical impact is exerted to the brittle material fine particles and the ductile material fine particles, and the brittle material fine particles and the ductile material fine particles are deformed or fractured by the impact; in the brittle material, mutual rejoining of the fine particles is made through the intermediary of an active surface newly generated by the distortion or fracture, and furthermore an anchor portion with a part thereof biting the substrate surface is formed, to join with the substrate, in the boundary portion between the substrate and/or the ductile material fine particles; and there is thus formed the structure body, above the anchor portion, in which the brittle material crystals and the crystals and/or micro structures of the ductile material are dispersed.

In this case, similarly to the above described case, there may be used the composite fine particles which are formed by coating the surface of the brittle material fine particles with ductile materials.

As described above, the present invention has paid attention to the active surface newly generated by the distortion or fracture induced when the impact is exerted to the brittle material fine particles. In this connection, if the internal distortion of the brittle material fine particles is small, the brittle material fine particles are hardly distorted or fractured when bombarded; on the contrary, if the internal distortion of the brittle material fine particles is large, large cracking is induced for cancellation of the internal distortion, accordingly the brittle material fine particles undergo fracture/agglomeration before bombardment, and the bombardment of the agglomerates thus formed against the substrate hardly leads to the formation of the newly generated surface. Consequently, for the purpose of obtaining the composite structure body involved in the present invention, the particle size and the bombardment velocity of the brittle material fine particles are of course important, but it is even more important to provide the brittle material fine particles as the raw material with the internal distortion falling within the prescribed range. The most preferable internal distortion is such a distortion as is increased up to the limit immediately beyond which the crack comes to be formed, but such fine particles with some crack formed but with some remaining internal distortion can be satisfactorily used.

In the method for manufacturing the composite structure body involved in the present invention (the ultra-fine particles beam deposition method), it is preferable to use the brittle material fine particles which have the average particle size ranging from 0.1 to 5 μm and the large internal distortion formed beforehand. The velocity of the above particles falls within the range preferably from 50 to 450 m/s, more preferably from 150 to 400 m/s. These conditions are intimately related to whether the newly generated surface is formed when the particles are bombarded against the substrate and in other like cases; the particle size smaller than 0.1 μm is too small and hardly induces the fracture or distortion. When the average particle size exceeds 5 μm, the fracture occurs partially, but substantially there comes to operate the film abrasion effect ascribable to etching, and it is sometimes the case that the process goes no further than the deposition of the green compacts made of the fine particles without causing fracture. Similarly, when a structure body is formed with this average particle size, there has been observed the phenomenon in which the green compacts are mixed in the structure body at the particle velocity of 50 m/s or less, and it has been found that at the particle velocity of 450 m/s or more, the etching effect becomes appreciable and the structure body formation efficiency becomes degraded. The method of measuring these velocities is based on Example 3.

One of the characteristics of the method of manufacturing the composite structure body involved in the present invention consists in that the manufacturing can be conducted at room temperature or at relatively low temperatures, which permits the choice of such low-melting point materials as resins as the substrate.

However, a heating process may be added to the method of the present invention. The formation of the structure body of the present invention is characterized in that in the structure body formation, there hardly occurs the heat generation at the time of the distortion/fracture formation of the fine particles, and nevertheless a dense structure body is formed; the structure body can be formed satisfactorily in the environment of room temperature. Accordingly, although heat is not necessarily required to be involved in the structure body formation, it is conceivable that the heating of the substrate or the heating of the environment for forming the structure body is conducted for the purpose of drying the fine particles and removal of the surface adsorbates, heating for activation, aiding the anchor portion formation, alleviation of thermal stress between the structure body and the substrate in consideration of the environment in which the structure body is used, removal of the substrate surface adsorbates, and improvement of the efficiency of the structure body formation. Even if this is the case, it is not necessary to apply such a high temperature as inducing the melting, sintering, or extreme softening of the fine particles and substrate. Additionally, it is also possible to conduct the structure control of the crystal by the heat processing at the temperatures not higher than the melting point of the brittle material, after the formation of the structure body composed of the polycrystalline brittle material.

Additionally, it is preferable to implement under a reduced pressure the method of manufacturing the composite structure body involved in the present invention, in order to maintain to some extent of time the activity of the newly generated surface formed on the raw material fine particles.

Additionally, when the method of manufacturing the composite structure body involved in the present invention is embodied on the basis of the ultra-fine particles beam deposition method, it is conceivable to control the electric characteristics, mechanical characteristics, chemical characteristics, optical characteristics, and magnetic characteristics of the structure body by controlling the element deficiency quantities in the compounds constituting the structure body composed of the brittle material through controlling the type and/or partial pressure of the carrier gas such as oxygen gas, by controlling the oxygen quantity in the structure body, and by forming the oxygen deficient layer in the vicinity of the boundary face in the case where the metal oxides are present in the structure body.

In other words, if such an oxide as aluminum oxide is used as the raw material fine particles in the ultra-fine particles beam deposition method, and the structure body is formed by suppressing the partial pressure of the oxygen used in this method, it is conceivable that the oxygen escapes into the gas phase from the surface of the fine fragment particles when the fine particles undergo fracture to yield the fine fragment particles, and accordingly the oxygen deficiency and the like occur on the surface phase. There occurs thereafter the mutual rejoining of the fine fragment particles, and consequently the oxygen deficient layer is formed in the vicinity of the boundary face between the crystal grain. Additionally, the element to be made deficient is not limited to oxygen, but may include nitrogen, boron, carbon, and the like; the deficiency of these elements is achieved by the nonequilibrium state partition of the elemental quantities between the gaseous and solid phases or by the reaction-induced elimination of the elements, through controlling the partial pressures of the particular types of gases.

DETAILED DESCRIPTION INCLUDING BEST MODE FOR CARRYING OUT THE INVENTION

In the next place, description is made on an embodiment of the method for manufacturing a composite structure body in the present invention.

Figure 1:
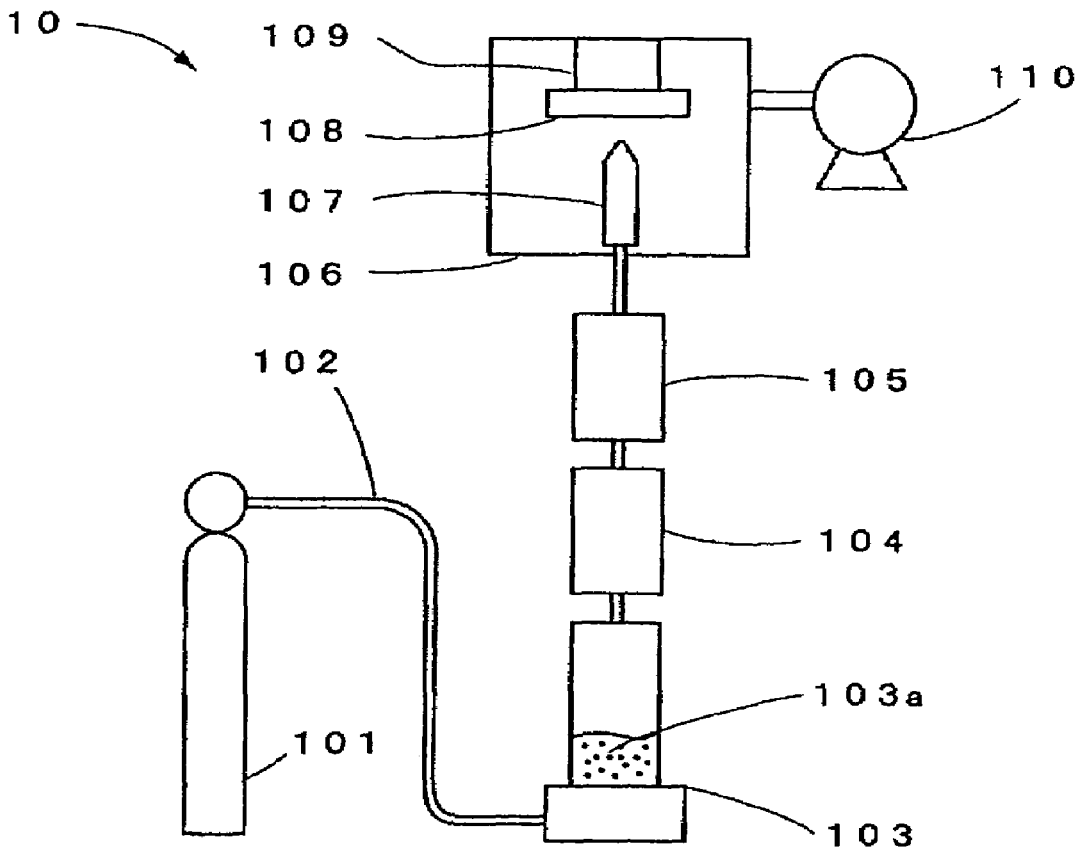
FIG. 1 shows a diagram illustrating an apparatus for manufacturing a structure body as an embodiment of the present invention.

There is prepared beforehand the powder composed of the composite fine particles formed by coating with a metal the surface of the powder composed of the brittle material fine particles having a submicron particle size, imparted a distortion by using a planetary mill, and a structure body is formed on a substrate with the prepared powder by means of the ultra-fine particles beam deposition method. FIG. 1 shows a diagram illustrating the apparatus used for the ultra-fine particles beam deposition method.

In the apparatus 10 for manufacturing a composite structure body in FIG. 1, a nitrogen gas cylinder 101 is connected, through a carrier pipe 102, to an aerosol generator 103, a disintegrating machine 104 is arranged at a position downstream thereof, and a classifier 105 is arranged at a position further downstream thereof. A nozzle 107, arranged in a structure body formation chamber 106, is arranged at one end of the carrier pipe 102 communicatively connecting these above described devices. In front of the opening of the nozzle 107, there is arranged a substrate 108 made of iron which is mounted on an XY stage 109. The structure body formation chamber 106 is connected to a vacuum pump 110. The aerosol generator 103 stores internally the above composite fine particle powder 103*a* composed of the aluminum oxide fine particles and silicon oxide fine particles.

Description is made below of the operation of the apparatus 10 for manufacturing a composite structure body which apparatus comprises the above described configuration. The above composite fine particle powder 103*b* is prepared by mixing the aluminum oxide fine particles and silicon oxide fine particles both imparted the internal distortion by pulverizing beforehand with a planetary mill that is the distortion imparting unit unshown in the figure, and the mixed power 103*a* is put into the aerosol generator 103. The nitrogen gas is introduced, from the nitrogen gas cylinder 101 through the carrier pipe 102, into the aerosol generator 103 charged with the mixed powder, and the aerosol generator 103 is operated to generate the aerosol containing the composite fine particles. The fine particles in the aerosol are agglomerated to form the secondary particles of about 100 μm, which are introduced through the carrier pipe 102 into the disintegrating machine 104 to be converted to the aerosol containing the primary particles in a large fraction. The aerosol is thereafter introduced into the classifier 105 to remove the coarse secondary particles in the aerosol remaining undisintegrated by the disintegrating machine 104, so that the aerosol is converted to the aerosol further enriched in the primary particles, and then guided out therefrom. Then, the aerosol is sprayed at a high speed against the substrate 108 from the nozzle 107 arranged in the structure body formation chamber 106. While bombarding the aerosol against the substrate 108 arranged in front of the nozzle 107, the substrate 108 is fluctuated with an XY stage 109 to form a thin film structure body over a certain area on the substrate 108. The structure body formation chamber 106 is placed in an environment with a reduced pressure of about 10 kPa provided by a vacuum pump 110.

Incidentally, among the above described structure body formation processes, the aerosol generator 103, disintegrating machine 104, and classifier 105 may be either of the separated type or of the integrated type. When the performance of the disintegrating machine is sufficiently satisfactory, no classifier is needed. Additionally, as for the mill pulverization of the fine particles, the mill pulverization may be conducted before, after or at the same time of the metal coating. In the case where the mill pulverization and the metal coating are conducted at the same time, the coating is performed during the disintegration by the mill charged with, for example, the power composed of a mixture of the metal fine particles and the brittle material fine particles. Needless to say, a variety of coating methods are conceivable, and the coated fine particles can be prepared beforehand by means of a variety of methods including, for example, the PVD, CVD, plating, sol-gel methods, and the like.

It is preferable that the composition of the structure body can be controlled without restraint because the type of the brittle material fine particles is not limited to one type, many types can be easily mixed together, this is also the case for the coating material that is the ductile material, and the mixing ratios of these materials can be optionally specified. The gas used is not limited to nitrogen gas, but can arbitrarily be argon, helium, or the like; it is conceivable that the oxygen concentration in the structure body is varied by mixing oxygen with any one of these cited gases.

In the next place, description is made on another embodiment of the method for manufacturing a composite structure body in the present invention.

Figure 2:
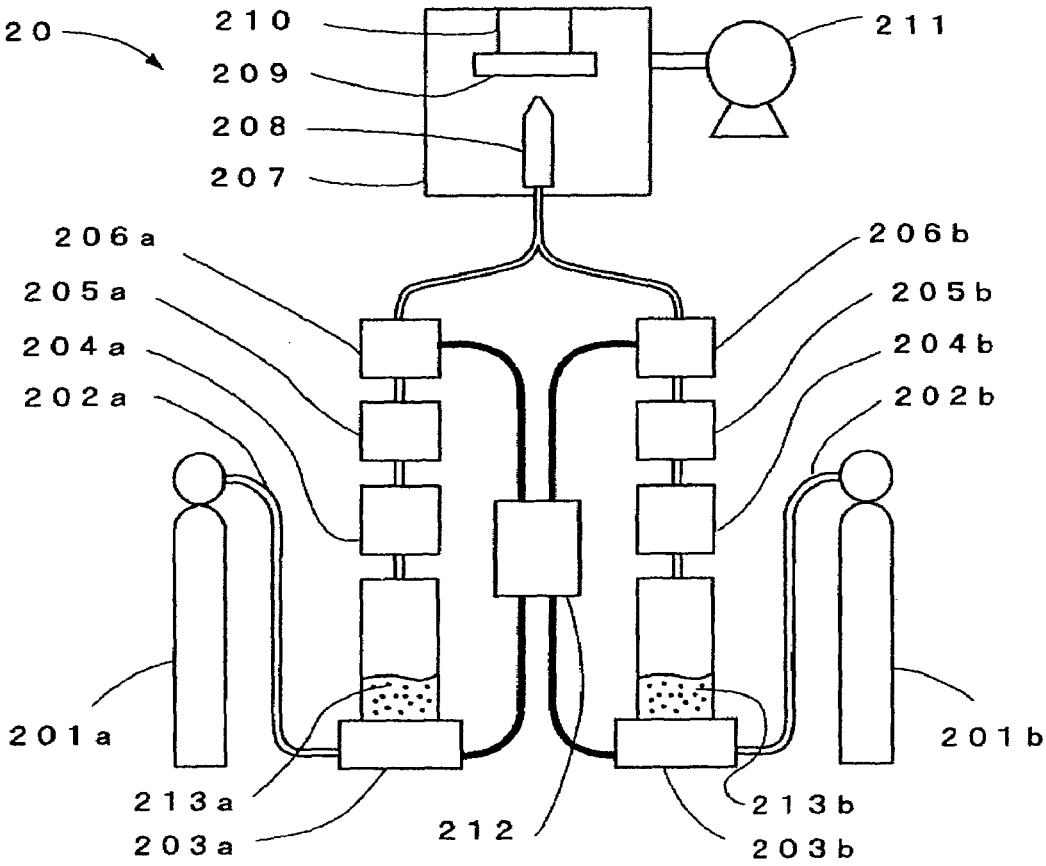
FIG. 2 shows a diagram illustrating an apparatus for manufacturing a structure body as an embodiment of the present invention.

FIG. 2 shows the apparatus 20 for manufacturing the composite structure body; in the apparatus 20 for manufacturing the composite structure body, argon gas cylinders 201*a*, 201*b* are connected, through carrier pipes 202*a*, 202*b*, respectively to aerosol generators 203*a*, 203*b*, disintegrating machines 204*a*, 204*b* are arranged at further downstream positions, classifiers 205*a*, 205*b* are arranged at further downstream positions, and aerosol concentration measurement instruments 206*a*, 206*b* are arranged at further downstream positions. The carrier pipes 202*a*, 202*b* communicatively connecting these are merged at positions downstream of the aerosol concentration measurement instruments 206*a*, 206*b*, and communicatively connected to a nozzle 208 arranged in a structure body formation chamber 207.

Incidentally, it is not necessarily needed to arrange the disintegrating machines at positions downstream of the aerosol generators storing internally the ductile material fine particles.

In front of the opening of the nozzle 208, there is arranged a metallic substrate 209 mounted on an XY stage 210. The structure body formation chamber 207 is connected to a vacuum pump 211. Additionally, the aerosol generators 203*a*, 203*b* and the aerosol concentration measurement instruments 206*a*, 206*b* are wired to a controller 212. One of the aerosol generators 203*a*, 203*b* stores internally fine particles 213*a* of brittle materials of the order of 0.5 μm in average particle size, and the other stores internally fine particles 213*b* of ductile materials.

Description is made below of the operation of the apparatus 20 for manufacturing a composite structure body which apparatus comprises the above described configuration. The brittle material fine particles 213*a* and the ductile material fine particles 213*b*, both imparted the internal distortion by pulverizing beforehand with a planetary mill that is the distortion imparting unit unshown in the figure, are respectively put into the aerosol generators 203*a*, 203*b*. Then, the valves of the argon gas cylinders 201*a*, 201*b* are opened and the respective argon gases are introduced into the aerosol generators 203*a*, 203*b*, through the carrier pipes 202*a*, 202*b*. Receiving the control of the controller 212, the aerosol generators 203*a*, 203*b* operate to respectively generate the aerosols. The brittle material fine particles 213*a* and the ductile material fine particles 213*b* are agglomerated in these aerosols to form the secondary particles of the order of 100 μm, which are introduced into the disintegrating machines 204*a*, 204*b* and are converted to the aerosols enriched in the primary particles. Subsequently, the aerosols are introduced into the classifiers 205*a*, 205*b* to remove the coarse secondary particles in the aerosols remaining undisintegrated by the disintegrating machines 204*a*, 204*b* so that the aerosols are converted to the aerosols further enriched in the primary particles, and then guided out therefrom. Then, these aerosols pass through the aerosol concentration measurement instruments 206*a*, 206*b*, where the fine particle concentrations in the aerosols are monitored, and then are merged and sprayed at a high speed against the substrate 209 from the nozzle 208 arranged in the structure body formation chamber 207.

The substrate 209 is fluctuated with the XY stage 210, and accordingly by varying the bombardment position of the aerosol against the substrate 209 from moment to moment, the brittle material fine particles 213*a* and the ductile material fine particles 213*b* are bombarded against a wide area on the substrate 209. The brittle material fine particles 213*a* are crushed or distorted when colliding, and these particles are joined to form a dense structure body in which the crystals are present as independently dispersed with the crystal size not larger than the average particle size of the primary particles, namely, with the nanometer size. Additionally' the interior of the structure body formation chamber 207 is evacuated with the vacuum pump 211, and the internal pressure is controlled to take a constant value of about 10 kPa.

Thus, on the substrate 209 is formed the structure body in which the brittle materials and the ductile materials are dispersed; in this case the results monitored on the aerosol concentration measurement instrument 206*a*, 206*b* are analyzed by the controller 212, and fed back to the aerosol generators 203*a*, 203*b*, to control the generated amount and concentration of the aerosol so that the abundance ratios of the brittle materials and the ductile materials in the structure body can be controlled either to be constant or to be inclined. In the case where such inclined materials are manufactured, the abundance ratios are easily varied either along the deposition height direction or the abundance distributions are easily varied along the surface direction of the substrate 209, in conjunction with the XY stage. Additionally, it is also possible to form a structure body by spraying a plurality of types of aerosols, without being merged, through separate nozzles. In this case, there is obtained a structure body composed of a thin deposited layer, and the inclination generation is easily carried out by controlling the thickness. Additionally, the fine particles stored internally in the aerosol generators may be either composite fine particles or mixed fine particles of a plurality of brittle materials and ductile materials; there only have to be chosen the internal storage modes suitable for achieving the target structure of the structure body. The gas composition is also optional. Additionally, as for the ductile material, instead of the above described aerosol generator in which the fine particle powder is stored beforehand, there may be used the method of evaporation in the gas in which method the bulk is evaporated and then abruptly cooled to form fine particles, and other like methods.

EXAMPLE 1

There was prepared beforehand the aluminum oxide fine particles, as the brittle material fine particles, of 0.6 μm in average particle size with the internal distortion impressed by the pulverization treatment with a planetary mill, then the metallic nickel fine particles, as the ductile material fine particles, of 0.4 μm in average particle size were added to the above aluminum oxide fine particles in a weight ratio of 0.1%, the mutual mixing of these fine particles was conducted by use of a dry ball mill to produce the composite fine particle powder, the aerosol generator in the apparatus for manufacturing a composite structure body corresponding to FIG. 1 was charged with the composite fine particle powder, and a composite structure body was formed on a brass substrate with a formation height of 10 to 15 μm and a formation area of 17×20 mm In this case, the pressure in the structure body formation chamber was 0.2 kPa. For comparison, a composite structure body was also formed in a similar manner using the aluminum oxide fine particles but without using the ductile material fine particles. As for the formed composite structure bodies, the composite structure body containing only aluminum oxide was transparent and colorless, while the composite structure body containing nickel exhibited a color tinged with black. The volume resistivity and relative dielectric constant were measured for each of these structure bodies and the results obtained are shown in Table 1. The volume resistivity measurement was conducted as follows: the surface of a formed structured body was mirror-polished to be flat and smooth to a sufficient extent; a circular gold electrode of Φ13 mm and an external electrode of 1 mm in width were formed, outside thereof, concentrically on the structure body surface with a 1 mm width of gap intervening between these two electrodes, and the brass substrate was used as the lower electrode; the measurement specimen thus formed was applied a voltage of 100 V between the circular electrode and the lower electrode, then the specimen was allowed to stand as it was for about 60 seconds to be stabilized, and the stabilized current value was read by a microammeter and the volume resistivity was obtained therefrom by applying Ohm's law. Subsequently, the relative dielectric constant $\epsilon$was measured as follows: a voltage of a measurement frequency of 1 MHz was applied between the gold electrode and the conductive substrate by using a Hewlett-Packard Impedance/Gain-Phase Analyzer HP4194A, and the electrostatic capacity of the structure body was measured at 25° C. and at a humidity of 50%, from which the relative dielectric constant was obtained. The formation height of the structure body necessary for evaluation of these values was measured by using a stylus-type surface profile measuring system Dektak 3030 manufactured by Nihon Shinku Gijutsu Co.

As can be seen from Table 1, the aluminum oxide-nickel composite structure body is smaller by one order of magnitude in the volume resistivity and also smaller in the relative dielectric constant, as compared to the aluminum oxide composite structure body.

TABLE 1

The volume resistivities and relative dielectric constants of the structure bodies

| | Volume resistivity | Relative dielectric constant (at 1 MHz) |
|---|---|---|
| Aluminum oxide-nickel composite structure body | $2.05 \times 10^9\ \Omega \cdot cm$ | 12.0 |
| Aluminum oxide composite structure body | $2.05 \times 10^{10}\ \Omega \cdot cm$ | 14.7 |

EXAMPLE 2

Figure 3:
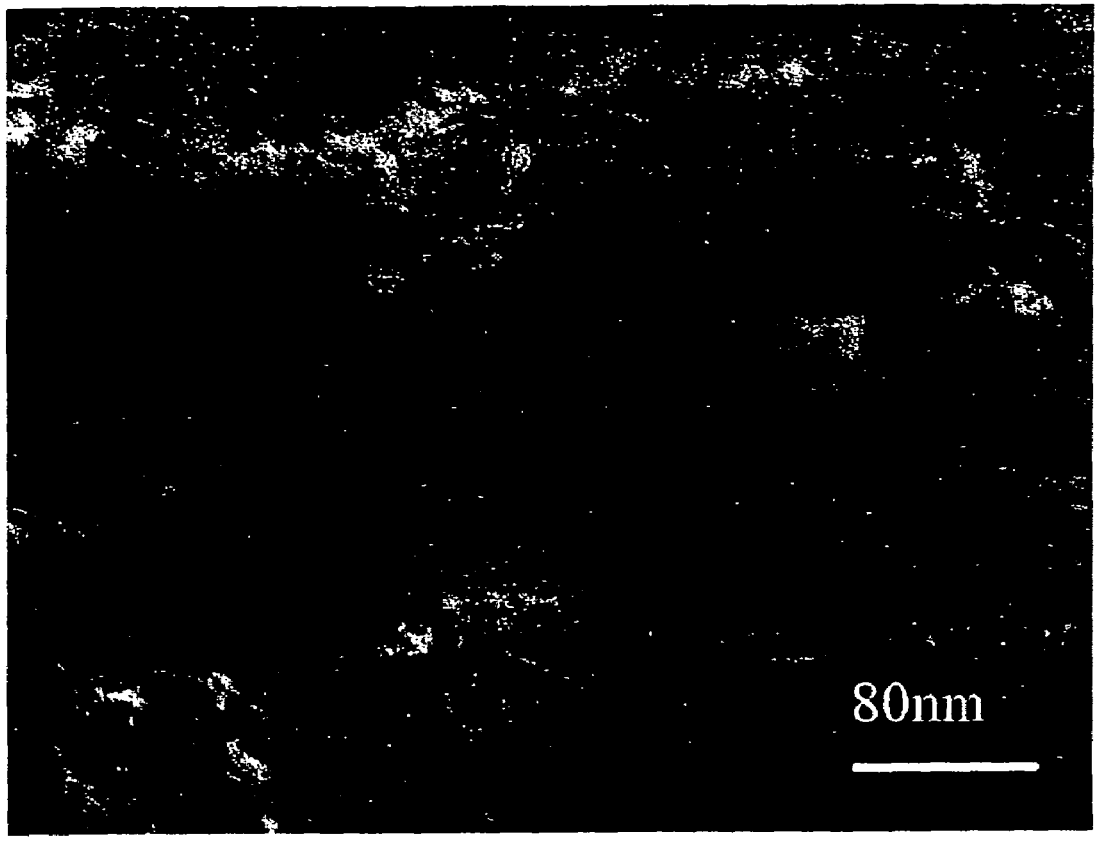
FIG. 3 shows the transmission electron microscope image of a structure body.

In Example 2, the composite structure body formation was performed in the formation procedures similar to those in Example 1, by preparing the composite fine particle powder composed of the aluminum oxide fine particle powder mixed with the single crystal metallic nickel fine particles of 20 nm in average particle size in a weight ratio of 5%. FIG. 3 shows the transmission electron microscope image of the obtained structure body. In the image, the black circular spots observed to be about 20 nm in diameter represent the single crystal metallic nickel fine particles, and the polycrystalline structure surrounds these spots. As can be seen from the image, the nickel is scattered in the aluminum oxide structure body, and the mutual joining of the aluminum oxide and the nickel forms a dense structure.

EXAMPLE 3

In Example 3, description is made of the measurement of the fine particle velocity at the time of the formation of a structure body.

Figure 4:
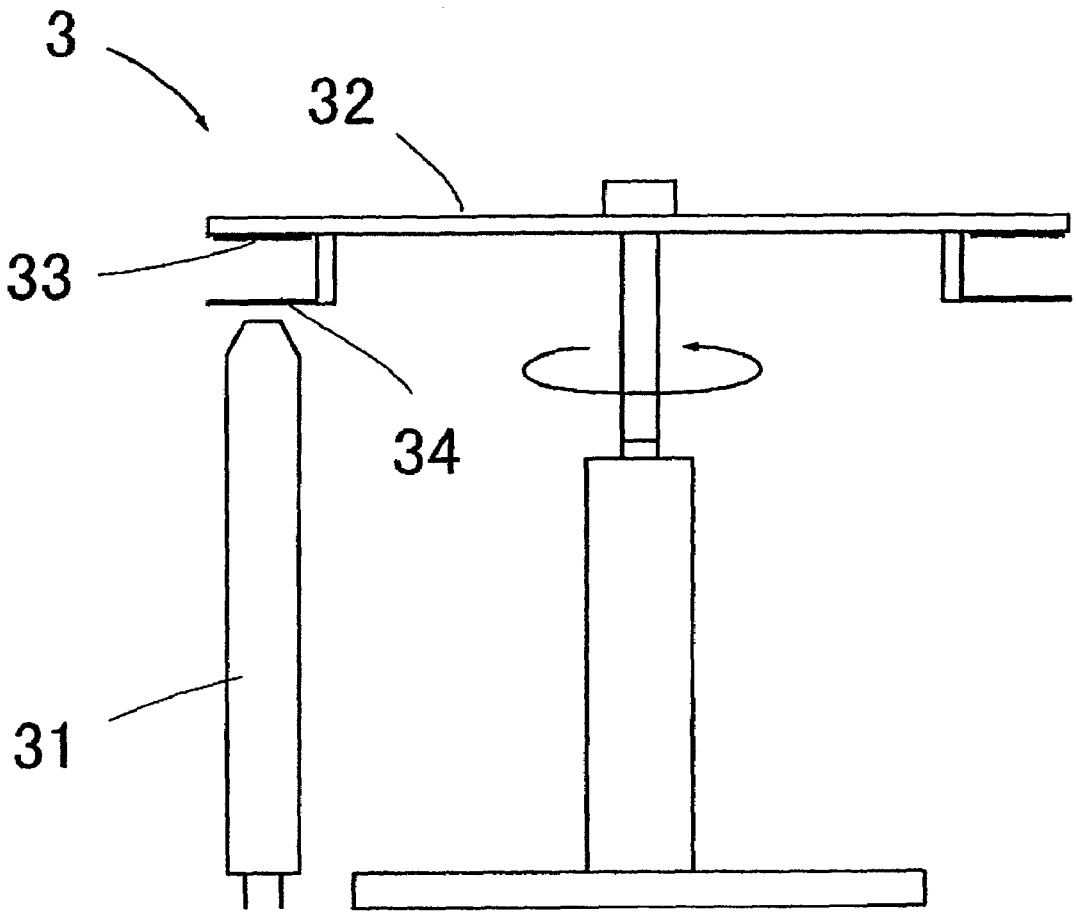
FIG. 4 shows a diagram illustrating an apparatus for measuring the fine particle velocity.

The following method was used for the above described measurement of the fine particle velocity. FIG. 4 illustrates an apparatus for measuring the fine particle velocity. There is arranged an apparatus 3 for measuring the fine particle velocity in which apparatus a nozzle 31 for spraying the aerosol into the interior of the chamber unshown in the figure is arranged with the opening thereof directed upward, and there are arranged in front of the opening a substrate 33 mounted on the peripheral end of a rotary vane 32 which is driven to revolve by a motor, and a slit 34 which is fixed at a position separated by 19 mm downward from the substrate surface and has a notch of 0.5 mm in width. The separation between the opening of the nozzle 31 and the substrate surface is 24 mm.

In the next place, a description is made of the method for measuring the fine particle velocity. The spray of the aerosol is conducted in conformity with the actual method for manufacturing the composite structure body. It is suitable to conduct the spray of the aerosol by arranging, in the structure body formation chamber, the apparatus 3 for measuring the fine particle velocity, shown in the figure, in place of the substrate for forming a structure body. Under a reduced pressure, the pressure of the chamber unshown in the figure is reduced to be several kPa or less, and then the aerosol containing fine particles is sprayed from the nozzle 31; under this condition, the apparatus 3 for measuring the fine particle velocity is driven to operate at a constant rotational speed. As for the fine particles ejected from the opening of the nozzle 31, when the substrate 33 comes above the nozzle 31, a part of the fine particles pass through the notch clearance of the slit 34 and are bombarded against the substrate surface to form a structure body (impact scar) on the substrate 33. While the fine particles reach the substrate surface separated by 19 mm from the slit, the substrate 33 is made to vary its position by the rotation of the rotary vane 32; so that the fine particles are bombarded against a position on the substrate 33 displaced by the above described position variation from the intersecting position of the perpendicular line dropped from the notch of the slit 34. The distance from the intersecting position of the perpendicular line to the structure body formed through the bombardment was measured by the surface irregularity measurement; as for the velocity of the fine particles sprayed from the nozzle 31, there was calculated the average velocity over the range from the position separated by 5 mm to the position separated by 24 mm from the opening of the nozzle 31, by using this distance, the distance from the substrate surface to the slit 34, and the rotational speed of the rotary vane 32, and this average velocity was defined as the fine particle velocity in the present invention.

INDUSTRIAL APPLICABILITY

As described above, the composite structure body involved in the present invention can provide a novel material having properties that cannot otherwise be provided, because in the composite structure body, brittle materials such as ceramics and ductile materials such as metals are combined to form a composite material at the nano level size.

Additionally, according to the method for manufacturing the composite structure body involved in the present invention, not only the film type but also arbitrary, 3-dimensional shaped composite structure bodies can be manufactured, so that the application of these structure bodies can be extended to all fields.

Furthermore, in the formation of the composite structure body on a substrate, it is possible to choose arbitrary substrates because the processes involved are conducted at low temperatures (about room temperature), but are not involved in heating, sintering, or the like.

Although there have been described what are the present embodiments of the invention, it will be understood by persons skilled in the art that variations and modifications may be made thereto without departing from the spirit or essence of the invention.

The invention claimed is:

1. A composite structure body in which on a surface of a substrate is formed a structure body in which crystals of at least one type of ceramic, semiconductor and/or metalloid brittle material, and crystals and/or the microstructures of at least one type of metal ductile material are dispersed, wherein: a portion composed of the crystals of said brittle material is polycrystalline; substantially no boundary layer composed of a glassy substance is present in a boundary face of said brittle materials; and a part of said structure body becomes an anchor portion biting the substrate surface.

2. The composite structure body according to claim 1, wherein the crystals constituting said polycrystalline portion do not have thermal grain growth.

3. The composite structure body according to claim 1, wherein in said polycrystalline portion the average crystallite size is 500 nm or less and the denseness degree is 70% or more.

4. The composite structure body according to claim 1, wherein in said polycrystalline portion the average crystallite size is 100 nm or less and the denseness degree is 95% or more.

5. The composite structure body according to claim 1, wherein in said polycrystalline portion the avenge crystallite size is 50 nm or less and the denseness degree is 99% or more.

6. The composite structure body according to claim 1, wherein the crystals constituting said polycrystalline portion are 2.0 or less in aspect ratio.

7. The composite structure body according to claim 1, wherein tile elements other than a main metal element constituting the crystals are not segregated in the boundary face between the crystals constituting said polycrystalline portion.

8. The composite structure body according to claim 1, wherein said substrate is glass, a metal, a metalloid, a semiconductor, a ceramic, or an organic compound.

9. The composite structure body according to claim 1, wherein the crystals constituting the polycrystalline portion substantially lack crystalline orientation.

10. A composite structure body which is obtained through the following processes: bombarding brittle material fine particles and ductile material fine particles separately or simultaneously against a surface of a substrate with high velocities, thereby forming an anchor portion biting said substrate surface; said brittle material fine particles are simultaneously distorted or fractured by impact of the bombardment; mutual rejoining of said fine particles is made through intermediary of a newly generated active surface formed by the distortion or fracture; and thereby forming a structure body, above said anchor portion, in which crystals of the brittle material and crystals and/or microstructures of the ductile material fine particles are dispersed, and thus obtaining the composite structure body.

11. The composite structure body according to claim 10 which is formed through a further process of imparting internal distortion to said brittle material fine particles, as the pre-processing prior to bombarding the particles against the substrate surface.

12. The composite structure body according to claim 10, wherein said brittle material fine particles are 0.1 to 5 μm in average particle size.

13. The composite structure body according to claim 10, wherein said structure body is manufactured at room temperature.

14. The composite structure body according to claim 10, including a further process of structure control conducted by heat processing at temperatures not higher than the melting point of said structure body, after the formation of said structure body.

15. The composite structure body according to claim 10, wherein the structure body is manufactured under a reduced pressure.

16. The composite structure body according to claim 10, wherein a procedure for bombarding fine particles against said substrate surface at a high velocity involves spraying of aerosol, in which said fine particles are dispersed in a gas, against said substrate at a high velocity.

17. The composite structure body according to claim 16, wherein formation of the structure body involves controlling electric, mechanical, chemical, optical, and magnetic characteristics of said composite structure body through controlling the type of and/or partial pressures in said gas.

18. The composite structure body according to claim 16, wherein formation of the structure body involves controlling electric, mechanical, chemical, optical, and magnetic characteristics of said composite structure body through controlling oxygen partial pressure in said gas.

19. A composite structure body which is obtained through the following processes: forming composite fine particles by way of a process in which a surface of brittle material fine particles is coated with at least one type of ductile material; then by bombarding said composite fine particles against a surface of a substrate with high velocity, to form an anchor portion biting said substrate surface; said composite fine particles are simultaneously distorted and fractured by impact of the bombardment; mutual rejoining of said composite fine particles is made through intermediary of a newly generated active surface formed by the distortion or fracture; and thereby forming a structure body, above said anchor portion, in which crystals of the brittle material and crystals and/or microstructures of the ductile material fine particles are dispersed.

20. A composite structure body which is obtained through the following processes: arranging brittle material fine particles and ductile material fine particles on a surface of a substrate; exciting mechanical impact to the brittle material fine particles and the ductile material fine particles to form an anchor portion biting said substrate surface; said brittle material fine particles are simultaneously deformed or fractured by the mechanical impact; the mutual rejoining of said fine particles is made through intermediary of a newly generated active surface formed by the distortion or fracture; and thereby forming a structure body, above said anchor portion, composed of a structure in which crystals of the brittle material and crystals and/or microstructures of the ductile material are dispersed.

21. A composite structure body which is obtained through the following processes: forming composite fine particles by way of a process in which a surface of said brittle material fine particles is coated with at least one type of ductile material; then said composite fine particles are arranged on a surface of a substrate; an anchor portion biting said substrate surface is formed by exerting mechanical impact to the composite fine particles; said brittle material fine particles are simultaneously deformed or fractured by the mechanical impact; mutual rejoining of said fine particles is made through intermediary of a newly generated active surface formed by the distortion or fracture; and thereby forming a structure body, above said anchor portion, composed of a structure in which crystals of the brittle material and crystals and/or microstructures of the ductile material are dispersed.

* * * * *

UNITED STATES PATENT AND TRADEMARK OFFICE

CERTIFICATE OF CORRECTION

PATENT NO. : 7,175,921 B2
APPLICATION NO. : 10/399903
DATED : February 13, 2007
INVENTOR(S) : Hatono et al.

It is certified that error appears in the above-identified patent and that said Letters Patent is hereby corrected as shown below:

Column 1:
Line 63, change “NEW CERAMICS” to --New Ceramics--.

Column 4:
Line 42, change “more than one types” to --more than one type--.
Line 46, change “more than one types” to --more than one type--.

Column 7:
Line 32, change “poly(ethylene terephtalate)” to --poly(ethylene terephthalate)--.
Line 33, change “and the like. and” to --and the like.--.
Delete lines 34-60.

Column 9:
Line 18, change “one types of” to --one type of--.
Line 48, change “micro structures” to --microstructures--.

Column 14:
Line 14, change “size. Additionally’ the” to --size. Additionally, the--.
Line 67, change “17×20mm In” to --17×20mm. In--.

Column 15:
Line 26, change “$\epsilon$was measured as follows:” to --$\varepsilon$r was measured as follows: --.

Column 17:
Line 47, change “wherein tile elements” to --wherein the elements--.

UNITED STATES PATENT AND TRADEMARK OFFICE

CERTIFICATE OF CORRECTION

PATENT NO. : 7,175,921 B2
APPLICATION NO. : 10/399903
DATED : February 13, 2007
INVENTOR(S) : Hatono et al.

It is certified that error appears in the above-identified patent and that said Letters Patent is hereby corrected as shown below:

Column 18:

Lines 7-8, change "prior to bombarding the particles against the substrate surface." to --prior to imparting same.--.

Signed and Sealed this

Eleventh Day of September, 2007

JON W. DUDAS
*Director of the United States Patent and Trademark Office*